US007040842B2

(12) United States Patent
Stotzer

(10) Patent No.: US 7,040,842 B2
(45) Date of Patent: May 9, 2006

(54) METHOD AND DEVICE FOR MAKING A FOUNDATION MEMBER

(75) Inventor: Erwin Stotzer, Aichach (DE)

(73) Assignee: Bauer Mashinen GmbH, Schrobenhausen (DE)

( * ) Notice: Subject to any disclaimer, the term of this patent is extended or adjusted under 35 U.S.C. 154(b) by 0 days.

(21) Appl. No.: 10/786,600

(22) Filed: Feb. 26, 2004

(65) Prior Publication Data

US 2004/0244997 A1 Dec. 9, 2004

(30) Foreign Application Priority Data

Feb. 27, 2003 (DE) ..... 103 08 540

(51) Int. Cl.
*E02D 5/34* (2006.01)
*E02D 15/04* (2006.01)
*E02D 5/18* (2006.01)

(52) U.S. Cl. ..... 405/233; 405/248; 405/256; 405/269

(58) Field of Classification Search ..... 405/233, 405/235, 236, 241, 240, 248, 256, 269
See application file for complete search history.

(56) References Cited

U.S. PATENT DOCUMENTS 2,555,359 A * 6/1951 Montague ..... 405/238
3,604,214 A * 9/1971 Turzillo ..... 405/241
4,165,198 A * 8/1979 Farmer ..... 405/243
4,180,350 A * 12/1979 Watts ..... 405/233
4,533,279 A * 8/1985 van den Elzen et al. ... 405/239
4,640,649 A * 2/1987 Nakanishi ..... 405/237
4,662,792 A * 5/1987 Gessay ..... 405/233
4,906,142 A * 3/1990 Taki et al. ..... 405/267
4,971,480 A * 11/1990 Nakanishi ..... 405/269
5,263,797 A * 11/1993 Lindstrom et al. ..... 405/266
5,368,415 A * 11/1994 Kono et al. ..... 405/267
5,378,085 A * 1/1995 Kono et al. ..... 405/233
5,417,522 A * 5/1995 Kono et al. ..... 405/266
5,542,786 A * 8/1996 Blum ..... 405/240
5,560,739 A * 10/1996 Kunito ..... 405/237
5,707,180 A * 1/1998 Vickars et al. ..... 405/233
6,120,214 A * 9/2000 Iovino ..... 405/241
6,123,484 A * 9/2000 Fujita ..... 405/233
6,183,166 B1 * 2/2001 Schellhorn ..... 405/233
6,425,713 B1 * 7/2002 Fox et al. ..... 405/243
2001/0028827 A1 * 10/2001 Vickars et al. ..... 405/233
2003/0082012 A1 * 5/2003 Clark ..... 405/249

* cited by examiner

*Primary Examiner*—Michael Safavi
*Assistant Examiner*—Gay Ann Spahn
(74) *Attorney, Agent, or Firm*—Jacobson Holman PLLC

(57) ABSTRACT

A foundation member in the ground includes a soil working implement for loosening soil material in a soil area, a supply device for supplying a liquid to the loosened soil material and a mixing device for mixing the loosened soil material in the soil area with the liquid to form a settable suspension as well as a removal device for removing suspension from a first section of the soil area and a return device for returning at least part of the removed suspension to a second section of the soil area. A method for making a foundation member in the ground is also provided.

13 Claims, 1 Drawing Sheet

METHOD AND DEVICE FOR MAKING A FOUNDATION MEMBER

BACKGROUND OF THE INVENTION

1. Field of the Invention

The invention relates to a method for making a foundation member in the ground. In such methods a soil working implement, which loosens the soil material, is introduced into a soil or ground area, the loosened soil material in the soil area is mixed with a liquid to form a settable suspension and the suspension in the soil area is hardened to the foundation member.

The invention also relates to a device for making a foundation member in the ground. Such a device has a soil working implement for loosening soil material in a soil or ground area, as well as a supply device for supplying a liquid to the loosened soil material and a mixing device for mixing the loosened soil material in the soil area with the liquid to form a settable suspension.

2. Description of Related Art

The prior art is disclosed by DE 42 19 150 C1. In this known method a soil auger is inserted in the ground in corkscrew-like manner. As from a certain depth the advance of the soil auger is stopped, although the latter is still driven in rotary manner. This leads to a shearing and breaking up of the soil. Simultaneously a hardening or setting liquid is supplied to the soil. As a result of the action of the soil auger the broken up soil material is mixed with the liquid to form a hardening suspension, which following the extraction of the soil auger remains in the ground in order to harden there to form a column.

DE 198 25 169 C2 discloses a device for mixing a hardenable binder into the soil. This known device is provided with mixing blades fixed to a shaft for cutting up the soil material and mixing it with the hardenable binder.

In other known methods, soil material is removed using several parallel, juxtaposed soil augers and mixed in situ to form a soil material-binder suspension, which is hardened to form a sealing wall.

BRIEF SUMMARY OF THE INVENTION

The object of the invention is to provide a method and a device with which it is possible to make particularly high-quality foundation members.

This object is on the one hand achieved by a method for making a foundation member in the ground in which a soil working implement used for loosening soil material is introduced into a soil area, the loosened soil material in the soil area is mixed with a liquid to form a settable suspension and in the soil area the suspension is hardened to form the foundation member, wherein prior to hardening suspension is removed from a first section of the soil area and at least part of the removed suspension is returned to a second section of the soil area; and on the other by a device for making a foundation member in the ground having a soil working implement for loosening soil material in a soil area, a supply device for supplying a liquid to the loosened soil material and a mixing device for mixing the loosened soil material in soil area with the liquid to form a settable suspension, wherein a removal device is provided for removing suspension from a first section of the soil area and a return device is provided for returning at least part of the removed suspension to a second section of the soil area. Preferred embodiments of the invention appear in the dependent claims.

A method according to the invention is characterized in that prior to hardening suspension is removed from a first section of the soil area and that at least part of the removed suspension is returned to a second section of the soil area.

A fundamental idea of the invention is that part of the suspension mixed in the soil area is removed at a removal point and is at least partly returned to the soil area at another point. This counteracts-sedimentation and a precise suspension mixture is produced. In this way a particularly high-quality foundation member can be produced.

It is fundamentally possible to directly return removed suspension to the second section of the soil area. However, in particularly preferred manner the removed suspension is treated or prepared prior to the return action. Such a treatment can in particular involve a separation of a solid fraction from and/or a supply of substances to the suspension. Advantageously demanding takes place during treatment. As a function of the desired foundation member consistency, it can be advantageous to separate solid particles above and/or below a specific particle size. The separated solid fraction can be collected for use in further projects.

In principle, merely the part of the removed suspension returned to the soil area is treated. However, in particularly preferred manner the removed suspension is completely treated. This is particularly advantageous if the substances recovered during treatment are valuable. However, it can also be advantageous for only part of the suspension returned to the soil area to undergo a treatment.

In a particularly preferred development of the invention the removal and return of the suspension take place continuously and in particular simultaneously. This obviates the need for complicated storage means for the removed suspension. The removal and/or return of the suspension can take place during the sinking of the soil working implement, but preferably also during the extraction of the soil working implement. It can also be advantageous to perform the removal and/or return when the soil working implement is stationary.

The method according to the invention is preferably performed in such a way that a height of rise of the suspension in the soil area is at least approximately kept constant. This in particular avoids an overflow of suspension from the soil area. For this purpose the method is preferably performed in such a way that the volume flow of the removed suspension corresponds at least approximately to the sum of the volume flow of the returned suspension, the volume flow of the liquid and the volume change in the soil area as a result of the sinking or extraction of the soil working implement. Preferably the height of rise in the soil working area is established by means of a per se known measuring device and the outflow of suspension and the inflow of suspension of liquid from or into the soil area is regulated by means of an electronic control in order to obtain the height of rise.

It is fundamentally possible to carry out the loosening of the soil material and the mixing with liquid by means of the soil working implement in a number of method steps and optionally in alternating manner. However, it is particularly preferred to perform the loosening and mixing of the soil material through the soil working implement at the same time. The removal and return of suspension can also take place at the same time. This makes it possible to produce foundation members, such as foundation walls, bulkheads, sealing walls, etc. in the ground in a particularly time-saving manner.

In principle, the first and second sections of the soil area can be positioned in a random manner. However, preferably, the first soil area section is positioned above the second soil area section, which permits a particularly effective intermixing of the suspension in the soil area. It is particularly preferred that the suspension is removed directly below the height of rise of the suspension in the soil area. It is also advantageous to mix the suspension to be returned with the liquid and to feed the resulting mixture into the first soil area section. This makes it possible to reduce to a significant extent the expenditure for supply and discharge lines.

A device for making a foundation member in the ground according to the invention is characterized in that a removal device is provided for removing suspension from a first section of the soil area and that a return device is provided for returning at least part of the removed suspension to a second section of the soil area. As a result of the inventive removal device and inventive return device it is possible to bring about a suspension circulation in the soil area leading to a particularly good intermixing of the suspension. A device according to the invention can in particular be used for performing the above-described method.

A particularly preferred development of the inventive device is characterized in that the delivery device has a suction line located in an upper section of the soil area. This makes it possible to bring about a particularly effective circulation of the suspension in the soil area and at the same time low costs with regards to the running of lines. Preferably the suction line has a suction opening positioned directly below the height of rise of the suspension in the soil area. However, the delivery device can also have side-channel spillways into which the suspension flows solely as a result of gravity action on exceeding a fill level.

In particularly preferred manner the return device is constructed together with the supply device. In particular, it is possible to have a mixing device for mixing the returned suspension with the supplied liquid and a common supply line for supplying the resulting mixture to the second section of the soil area. The mixing device is preferably located outside the soil area, which further reduces costs with regards to the running of lines.

In a further embodiment of the invention a treatment device is provided for treating the suspension prior to return. Such a treatment device can in particular have filtering, screening or sedimenting devices for separating a solid fraction from the suspension and/or supply device for additives.

In principle, the soil working implement can be a random mixed-in-place implement. However, a particularly preferred embodiment of the inventive device is characterized in that the soil working implement has at least one drilling line or string with a soil auger and that the mixing device has mixing paddles located on the drilling string. Preferably there are several, particularly three such drilling strings in parallel. Such a device allows a particularly simple, rapid and cost-effective production of foundation members. Preferably, the supply device has outlet ports for suspension and/or liquid or a mixture thereof located in the vicinity of the soil auger and/or in the vicinity of the mixing paddles. Preferably there is also a drive for the rotary driving of the drilling string positioned outside the soil area. However, a soil working implement drive can also be provided in the soil area. The soil working implement can then have stripping wheels with circumferentially positioned stripping tools.

BRIEF DESCRIPTION OF THE DRAWINGS

The invention is described in greater detail hereinafter relative to an embodiment and the attached drawing, wherein is shown.

DETAILED DESCRIPTION OF THE INVENTION

Figure 1:
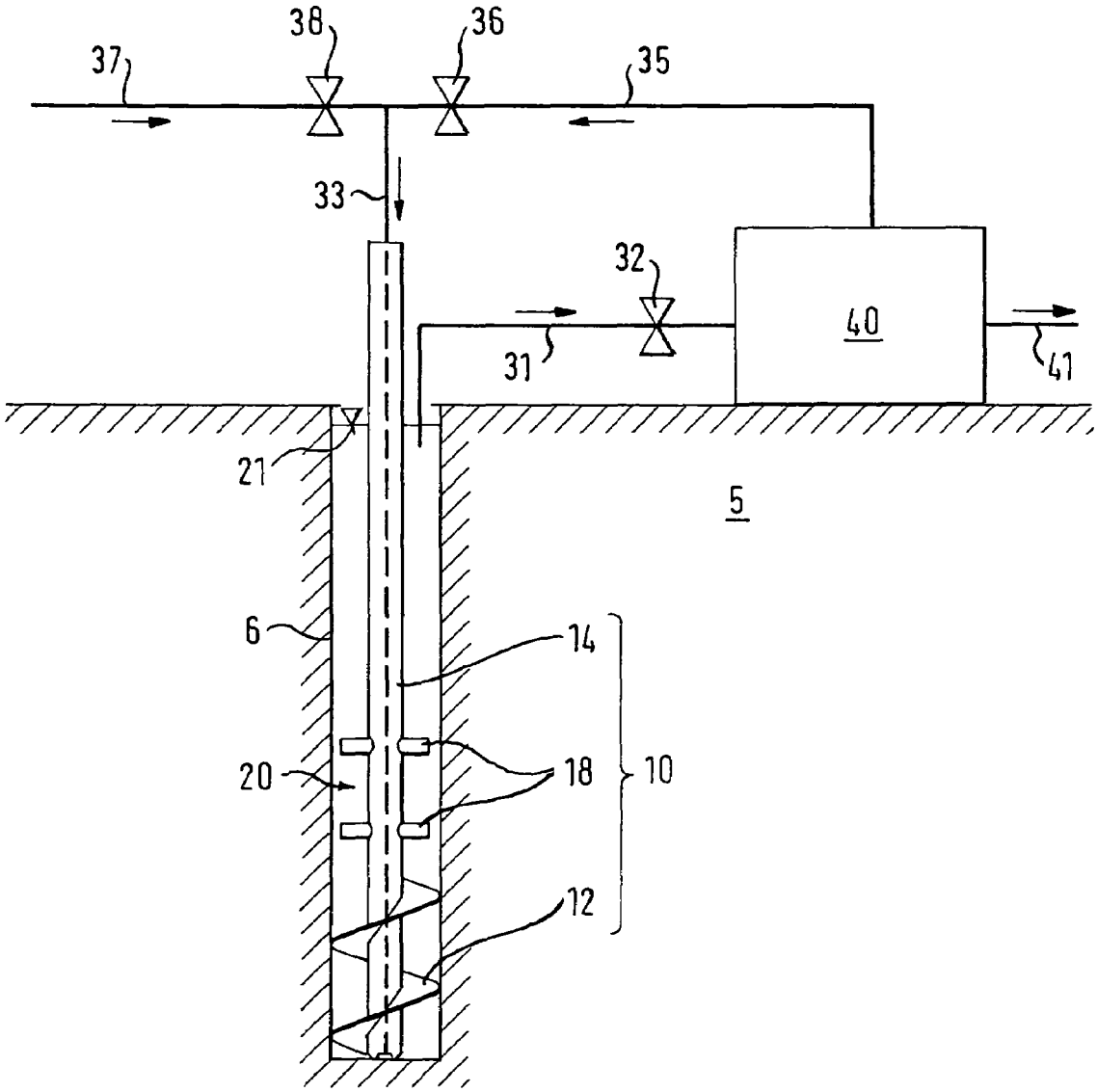
FIG. 1 A diagrammatic side view of a device according to the invention.

According to FIG. 1 a soil working implement 10 is provided, which has a soil auger 12 and mixing paddles 18, which are fixed to a drilling string 14. The soil working implement 10 loosens soil material in a cylindrical soil area 6 of the ground 5. By mixing the loosened soil material with a settable liquid by means of mixing paddles 18 and directly in the soil area 6, a suspension 20 is formed in situ which fills the soil area 6 up to the height of rise 21.

For removing the suspension 20 from a first section 46 of the soil area 6 a removal device 48 including a suction line 31 is provided and issues into a surface-near area. The removed material is supplied to a treatment device 40.

From the treatment device 40 pass out a removal line 41 for removing separated solids and/or liquid, as well as a return device 49 including a return line 35 for returning treated suspension 20 to a second section 47 of the soil area 6. The return line 35 is combined with a liquid line 37 for supplying liquid in a supply line 33. The supply line 33 runs in the interior of the drilling string 14 and issues at the lower end thereof in a discharge port. The volume flows of removed suspension, treated suspension and liquid are regulatable by valves 32, 36 or 38 or directly by the control system for the pumps. The directions of the volume flows in lines 31, 35, 37 and 41 are indicated by arrows in FIG. 1.

The invention claimed is:

1. Method for making a foundation member in the ground, comprising the steps of:

introducing into a soil area a soil working implement having a drilling string with a soil auger thereon for loosening the soil material in the soil area, using a mixing device having mixing paddles located on the drilling string, mixing the loosened soil material in the soil area with a liquid to form a settable suspension, removing from a first section of the soil area into which the soil working implement is introduced, at least a part of the suspension comprising the mixture of the loosened soil material with the liquid, and for generating a suction effect in the first section of the soil area, returning at least part of the removed suspension including a part of the loosened soil material to a second section of the soil area, and following the removing and returning steps, hardening the suspension in the soil area to form the foundation member wherein the removing and returning steps bring about a suspension circulation in the soil area leading to a particularly good intermixing of the suspension.

2. Method according to claim 1, wherein the removed suspension is treated prior to return.

3. Method according to claim 1, wherein the removal and return of the suspension are performed continuously.

4. Method according to claim 1, wherein the loosening and mixing of the soil material are carried out at the same time by the soil working implement.

5. Method according to claim 1, wherein the first section of the soil area is positioned above the second section of the soil area.

6. Method according to claim 1, further comprising the step of regulating the height of rise of the suspension in the soil area so as to keep it at least approximately constant.

7. Method according to claim 6, wherein the height of rise in the soil area is regulated by an electronic control.

8. Method according to claim 1, wherein in the step of removing at least a part of the suspension, the suspension is removed directly below a height of rise of the suspension in the soil area.

9. Method for making a foundation member in the ground, comprising the steps of:

(a) providing a device for making a foundation member in the ground, comprising:

a soil working implement including a drilling string having a soil auger thereon for loosening soil material in a soil area, a supply device for supplying a liquid to the loosened soil material and a mixing device including paddles located on the drilling string for mixing the loosened soil material in soil area with the liquid to form a settable suspension, a removal device for removing at least a part of the suspension including at least a part of the loosened soil material from a first section of the soil area into which the soil working implement is introduced, and for generating a suction effect in the first section of the soil area, and a return device for returning at least part of the removed suspension to a second section of the soil area, (b) introducing the soil working implement into a soil area to loosen the soil material therein, (c) supplying liquid to the loosened soil material in the soil area using the supply device, (d) mixing the loosened soil material in the soil area with the liquid, using the mixing device, to form a settable suspension, (e) hardening the suspension in the soil area to form the foundation member, wherein, (f) prior to hardening, at least a part of the suspension including at least a part of the loosened soil material is removed from a first section of the soil area into which the soil working implement is introduced, using the removal device, and (g) at least part of the removed suspension including at least a part of the suspension comprising the mixture of the loosened soil material with the liquid is returned to a second section of the soil area, using the return device; and wherein the removing step (f) and the returning step (g) bring about a suspension circulation in the soil area leading to a particularly good intermixing of the suspension.

10. Method according to claim 9, comprising the further step of treating the removed suspension prior to return in step (g).

11. Method according to claim 9, wherein the removal of step (f) and the return of the suspension of step (g) are performed continuously.

12. Method according to claim 9, wherein the loosening and mixing of the soil material of steps (b) and (d) are carried out at the same time by the soil working implement.

13. Method according to claim 9, wherein the first section of the soil area is positioned above the second section of the soil area.

* * * * *